US005418994A

United States Patent [19]

Rissik et al.

[11] Patent Number: 5,418,994

[45] Date of Patent: May 30, 1995

[54] UNDERWATER SURFACE CLEANING APPARATUS

[76] Inventors: George V. Rissik, 66 Goethe Road, Lombardy East, Transvaal Province; Wilbraham C. K. Vickers, 21 Lucas Road, Eastleigh, Edenvale, Transvaal Province, both of South Africa

[21] Appl. No.: 143,221

[22] Filed: Oct. 25, 1993

[51] Int. Cl.[6] ..... E04H 4/16

[52] U.S. Cl. ..... 15/1.7

[58] Field of Search ..... 15/1.7, 245, 188

[56] References Cited

U.S. PATENT DOCUMENTS

| | | | |
|---|---|---|---|
| 2,065,584 | 12/1936 | Hempel | 15/188 |
| 3,685,089 | 8/1972 | Langerstrom | 15/246 |
| 4,023,227 | 5/1977 | Chauvier | 15/1.7 |
| 4,351,077 | 9/1982 | Hofmann | 15/1.7 |
| 4,530,125 | 7/1985 | Hofmann | 15/1.7 |
| 4,949,419 | 8/1990 | Kallenbach | 15/1.7 |
| 5,259,082 | 11/1993 | Sebor | 15/1.7 |

*Primary Examiner*—Edward L. Roberts, Jr.

*Attorney, Agent, or Firm*—Marshall, O'Toole, Gerstein, Murray & Borun

[57] ABSTRACT

An apparatus for use in cleaning the underwater surfaces of swimming pools and the like includes a body with an inlet and an outlet for connection to a flexible suction hose; a flexible foot member adapted to at least partially surround the inlet; means for interrupting the flow between the inlet and the outlet and characterised in that the apparatus includes a plurality of feet projecting from the bottom of the body, each foot comprising a plurality of adjacent resiliently flexible members projecting in a direction away from the body and towards the rear thereof.

5 Claims, 1 Drawing Sheet

UNDERWATER SURFACE CLEANING APPARATUS

INTRODUCTION TO THE INVENTION

This invention relates to underwater surface cleaning apparatus and particularly to feet therefor.

BACKGROUND TO THE INVENTION

One common type of apparatus for use in cleaning underwater surfaces such as are found in swimming pools and the like includes a planar member of flexible material which is adapted to move across the surface to be cleaned. The flexible member surrounds a suction orifice of a body for the apparatus and which is connected via a mechanism to move the device and a flexible hose to the inlet of a filtration system for the pool. The suction orifice is spaced from the surface to be cleaned by a plurality of pads or feet of plastics material. These pads eventually wear away and may be replaced.

Because the pads or feet are generally relatively smooth they have little gripping ability and this accounts for the inability of many apparatuses to move satisfactorily over smooth surfaces such as tiles, painted and glass surfaces for example.

An object of this invention is to provide apparatus and feet therefor which have improved mobility characteristics when used on smooth surfaces.

SUMMARY OF THE INVENTION

According to the invention apparatus for use in cleaning underwater surfaces comprises:

a body having one inlet adapted to be spaced from a surface to be cleaned by a plurality of feet and an outlet adapted for connection to a flexible suction hose;

a flexible planar member adapted to at least partially surround the inlet; and means for repeatedly interrupting a flow of liquid between the inlet and the outlet, the apparatus being characterised in that each foot comprises a plurality of adjacent resiliently flexible members projecting in a direction away from the body.

Further, according to the invention, the flexible members are parallel to each other.

Still further, according to the invention, the members are at an acute angle to the general plane of the inlet and flexible planar member and project in a direction having a component opposite to that in which the apparatus is adapted to move.

Still further, according to the invention, the flexible members are flat members.

Still further, according to the invention, the flexible members project integrally from a base.

The invention also provides a foot comprising a base and a plurality of flexible members projecting therefrom.

Still further, according to this aspect of the invention, the base includes a locating formation projecting from the opposite side thereof to the flexible members and adapted to locate the foot in a corresponding formation in the body of an underwater surface cleaning apparatus.

BRIEF DESCRIPTION OF THE DRAWINGS

One embodiment of the invention described by way of example only follows with reference to the accompanying drawings in which.

DETAILED DESCRIPTION OF THE DRAWINGS

Figure 1:
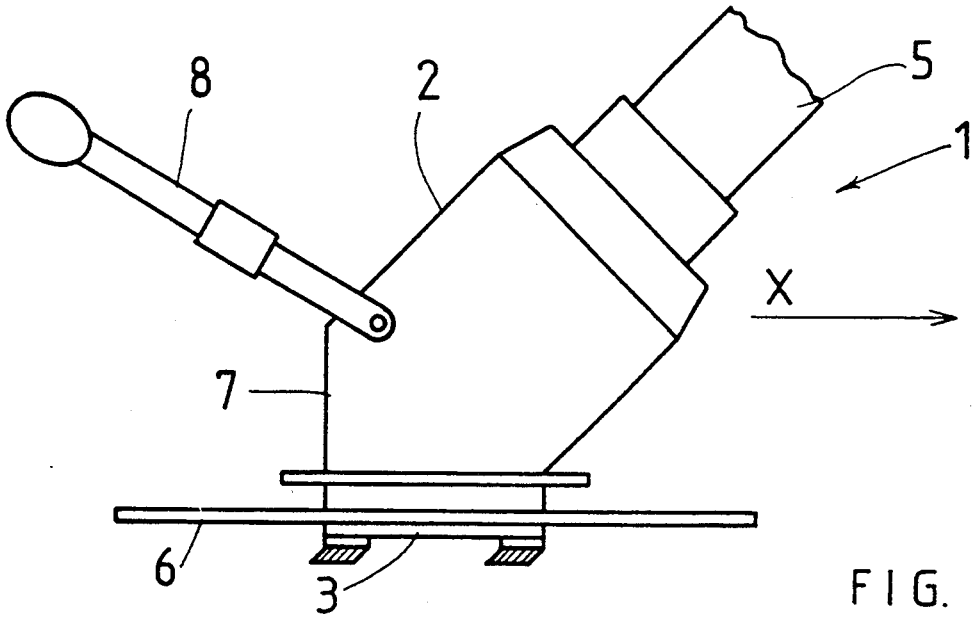
FIG. 1 is a side elevation of an underwater cleaning apparatus.
Figure 2:
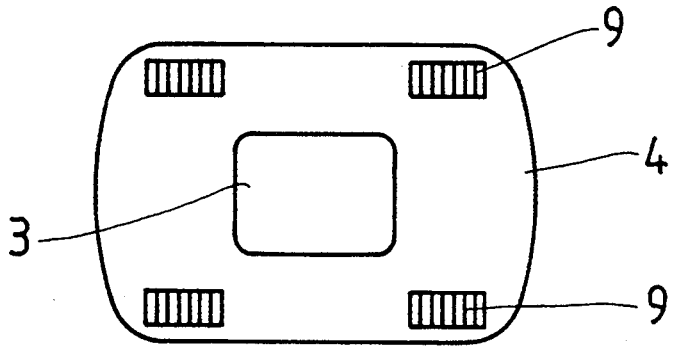
FIG. 2 is a plan of the underneath of part of the apparatus.
Figure 3:
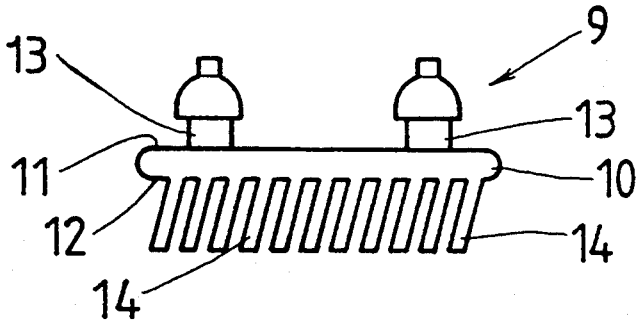
FIG. 3 is an enlarged side elevation of a foot for the apparatus.

In this embodiment of the invention apparatus (1) for use in cleaning the underwater surfaces of swimming pools and the like is provided.

The apparatus (1) comprises a body (2) having a rectangular inlet (3) in the bottom surface (4) thereof and outlets (5) at the top of the body, the outlets having their axis at an acute angle to the bottom of the body.

Surrounding the inlet (3) is a flexible planar member (6) which is adapted to be located adjacent the submerged surface to be cleaned but spaced therefrom by the bottom (4) of the body. Conveniently, the flexible member (6) has an aperture therethrough which is located in a groove surrounding the bottom (4).

At the rear (7) of the body is a hinged float member (8).

Surrounding the inlet (3) and mounted to the bottom (4) are four feet (9) for the apparatus. As may be seen, these feet are located at the corners of a rectangle.

Each foot (9) is an integrally moulded member of resiliently flexible plastics material and comprises a base (10) which is rectangular in plan view and has a top side (11) and a bottom side (12).

Projecting from the top side (11) are undercut locating formations (13) which serve to locate the feet in known manner in corresponding apertures (not shown) in the bottom (4) of the body (2) of the apparatus (1).

Projecting from the bottom side (12) of the base (10) are a plurality of flat resiliently flexible members (14). These members are adjacent but spaced from each other in a parallel manner and are at an acute angle to the plane of the base (10).

As may be seen from FIG. 1 the direction of the flexible members (14) is such that they have a component which is directed towards the rear end (7) of the body, that is, opposite to the direction of motion of the apparatus (1) as indicated by arrow "X" in FIG. 1.

The nature of the feet enables the apparatus to have an improved grip on smooth surfaces, particularly such as tiles, glass, painted surfaces and the like.

Other embodiments are envisaged within the scope of the invention including other shapes and configurations of the feet as well as their application to other types of cleaning devices.

What We claim as new and desire to secure by Letters Patent is:

1. Apparatus for use in cleaning underwater surfaces comprising a body having one inlet adapted to be spaced from a surface to be cleaned by a plurality of feet attached to a bottom surface of the body and an outlet adapted for connection to a flexible suction hose; a flexible planar member adapted to at least partially surround the inlet; and means for repeatedly interrupting a flow of liquid between the inlet and the outlet; the apparatus being characterized in that each foot comprises a plurality of adjacent resiliently flexible members projecting in a direction away from the body.

2. Apparatus as claimed in claim 1 in which the flexible members are parallel to each other.

3. Apparatus as claimed in claim 1 in which the members are at an acute angle to the general plane of the inlet and flexible planar member and project in a direction having a component opposite to that in which the apparatus is adapted to move.

4. Apparatus as claimed in claim 1 in which the flexible members are flat members.

5. Apparatus as claimed in claim 1 in which the flexible members project integrally from a base.

* * * * *